United States Patent [19]

Anderson

[11] 4,117,887

[45] Oct. 3, 1978

[54] SPRINKLER HEAD FLANGE ASSEMBLY

[75] Inventor: James R. Anderson, Berwyn, Pa.

[73] Assignee: Central Sprinkler Corporation, Landsdale, Pa.

[21] Appl. No.: 787,001

[22] Filed: Apr. 13, 1977

Related U.S. Application Data

[63] Continuation-in-part of Ser. No. 724,736, Sep. 17, 1976, Pat. No. 4,066,129.

[51] Int. Cl.[2] ..... A62C 37/12

[52] U.S. Cl. ..... 169/37; 285/46; 285/402

[58] Field of Search ..... 169/37–42; 239/288–288.5, 600; 285/46, 158, 303, 360, 361, 376, 396, 401, 402

[56] References Cited

U.S. PATENT DOCUMENTS

| | | | |
|---|---|---|---|
| 1,447,949 | 3/1923 | Hall et al. | 285/402 X |
| 1,845,882 | 2/1932 | Litschge | 285/361 |
| 2,389,332 | 11/1945 | Tyden | 169/37 |
| 3,393,746 | 7/1968 | Hodnett | 169/42 X |
| 3,998,273 | 12/1976 | Juliano | 169/37 |

FOREIGN PATENT DOCUMENTS

| | | | |
|---|---|---|---|
| 1,470,747 | 1/1967 | France | 285/361 |

*Primary Examiner*—Bruce H. Stoner, Jr.
*Assistant Examiner*—Andres Kashnikow
*Attorney, Agent, or Firm*—Fishburn, Gold & Litman

[57] ABSTRACT

A fire protection sprinkler head arrangement comprises a flange attached to a bracket on the sprinkler body by boss and shoulder joints, e.g., bayonet joints. The flange serves as a brace preventing sagging of ceiling tile and unwanted retraction of the sprinkler head rearwardly with respect to the ceiling or a sidewall. One embodiment of the flange is adjustable axially relative to the sprinkler body by an upwardly directed series of shoulder joints into which the boss is selectively fitted to conform to a particular ceiling or wall structure and feeder pipe system.

8 Claims, 11 Drawing Figures

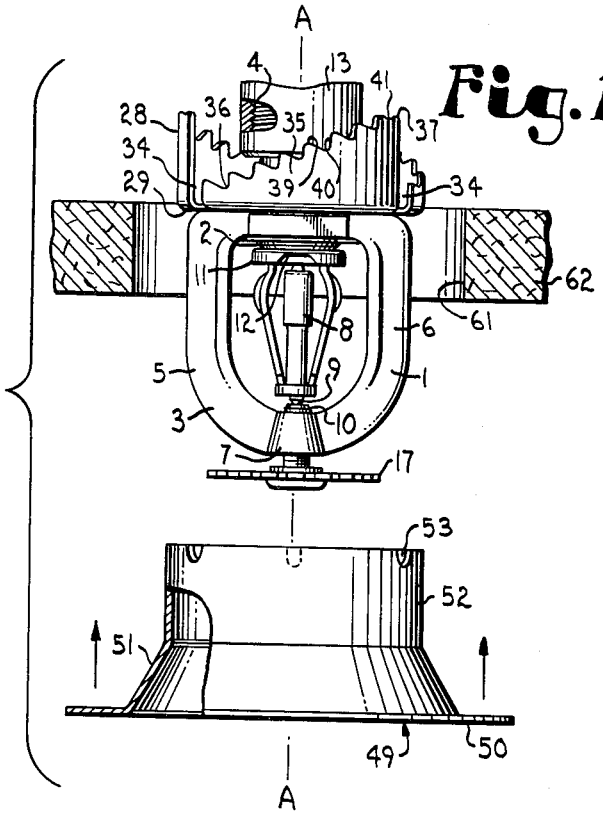
Fig. 1.
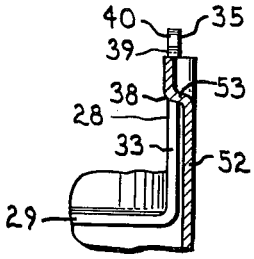
Fig. 4.
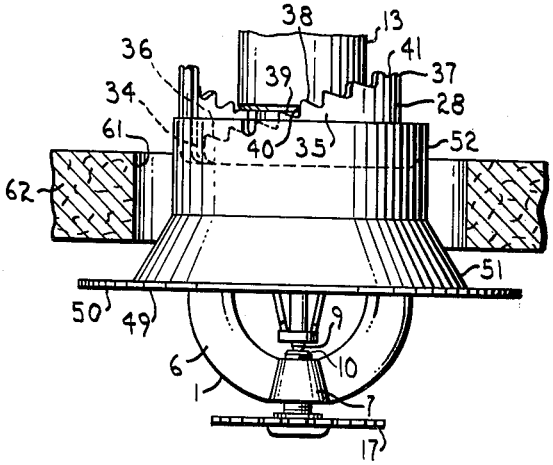
Fig. 2.
Fig. 3.
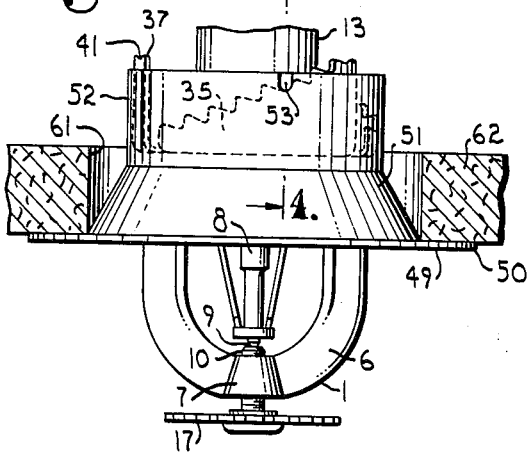

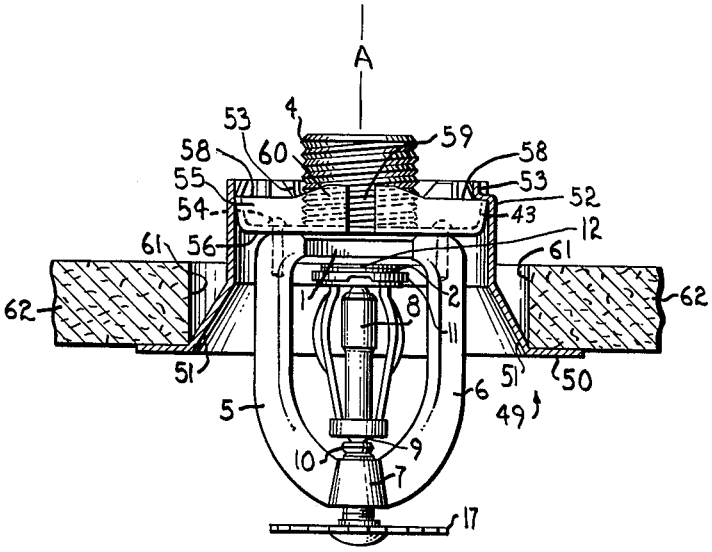
Fig. 9.
Fig. 10.
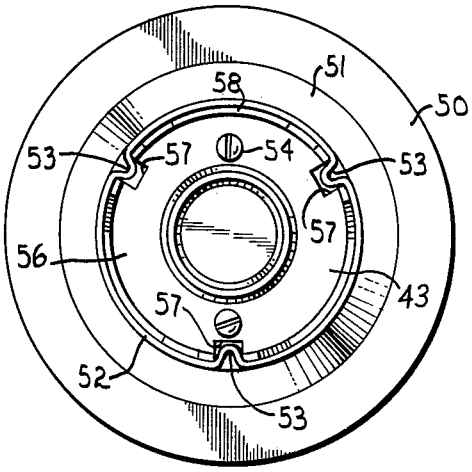
Fig. 11.
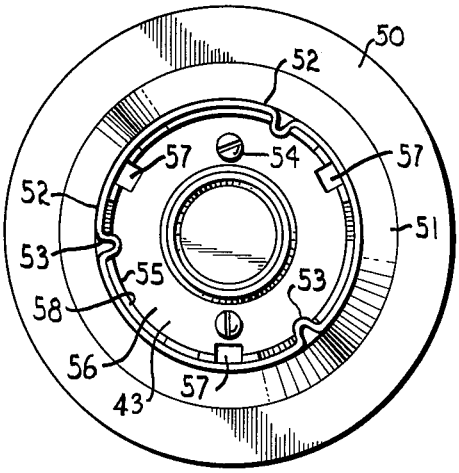

SPRINKLER HEAD FLANGE ASSEMBLY

BACKGROUND OF THE INVENTION

This is a continuation-in-part of application Ser. No. 724,736, filed Sept. 17, 1976, now U.S. Pat. No. 4,066,129 entitled SPRINKLER HEAD ASSEMBLY.

The present invention pertains to improvements in sprinkler heads employed with sprinkler systems which are installed in structures for protection against fire, and more particularly pertains to improvements in sprinkler arrangements which are provided with a flange or ring thereon for covering an opening in a ceiling or a sidewall in which the sprinkler is mounted.

When installing the sprinkler heads of a fire protection sprinkler system, holes are formed in the ceiling and/or walls of a room, and each hole is centered with respect to a corresponding sprinkler head which either lies behind the opening or extends partially or entirely therethrough. Since these holes are unfilled, or are only partially filled by the sprinkler head, flanges have been used as escutcheons for covering the openings. Such flanges, used in combination with sprinkler heads, are disclosed, for instance, in U.S. Pat. Nos. 2,389,331; 2,534,066; 3,393,746; 3,459,266; and 3,815,821. From these references it can be seen that the flanges disclosed therein for closing the openings around the sprinkler heads either have little bracing or relative locating effect with regard to supporting adjacent ceiling tile, or are attached to the sprinkler head permanently or by means of difficult to handle securing means. Thus, either secure bracing and relative locating are absent or installation and inspection are difficult and complicated.

OBJECTS OF THE INVENTION

It is therefore an object of the present invention to provide a sprinkler head having a flange thereon whereby the aforementioned disadvantages associated with prior sprinkler heads are avoided.

Another object is to provide a sprinkler head having a quickly and easily operated interlocking means whereby a hole-covering flange can be selectively attached to the sprinkler head and detached therefrom.

Still another object is to provide a sprinkler head having a flange thereon which serves as a brace that prevents sagging of adjacent ceiling tile, or that prevents retraction of the sprinkler head from an opening in a sidewall of a structure being protected against fire.

Yet another object is to provide a sprinkler head having an adjustable flange to accommodate various thicknesses and relative positions of ceiling tile and to adjustably prevent sagging of adjacent ceiling tile.

Other objects and advantages of the present invention will become apparent from the following description taken in connection with the accompanying drawings wherein are set forth, by way of illustration and example, certain embodiments of this invention.

BRIEF DESCRIPTION OF THE DRAWINGS

FIG. 1 is an exploded, partially sectional view in side elevation of a ceiling mounted, adjustable, semi-recessed, flanged sprinkler head with the flange shown disconnected therefrom.

FIG. 2 is a view similar to FIG. 1 showing the flange adjustably mounted to the sprinkler head but not adjusted to contact the ceiling tile.

FIG. 3 shows the flange adjusted upwardly to contact and support the ceiling tile in operational sequence with FIGS. 1 and 2.

FIG. 4 is an enlarged, sectional, fragmentary view in side elevation, taken along line 4—4, FIG. 3, showing a boss engaging one of a series of shoulder joints.

FIG. 9 is a view similar to FIG. 8 but showing the semi-recessed flange of FIG. 1 mounted on a non-adjustable shoulder joint.

FIG. 10 is a plan view of the flange and sprinkler head of FIG. 9 showing the bosses projecting into transfer channels in the bracket of the sprinkler head adjacent the shoulder joints.

FIG. 11 is a plan view similar to FIG. 9 but showing the bosses engaged on the shoulder joints.

DESCRIPTION OF THE EMBODIMENTS

Figure 5:
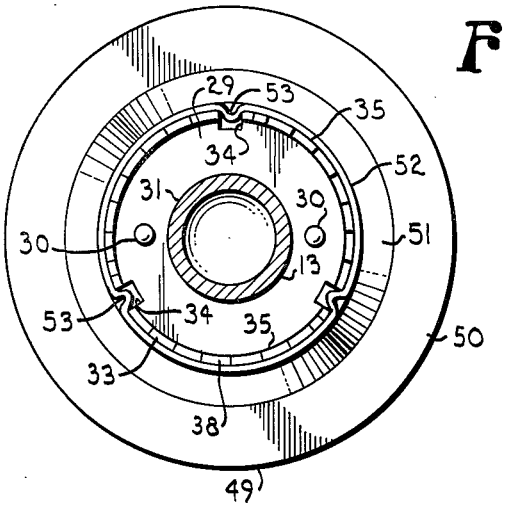
FIG. 5 is a plan view of the flange and head assembly, showing the bosses projecting into transfer channels adjacent the shoulder joints.
Figure 6:
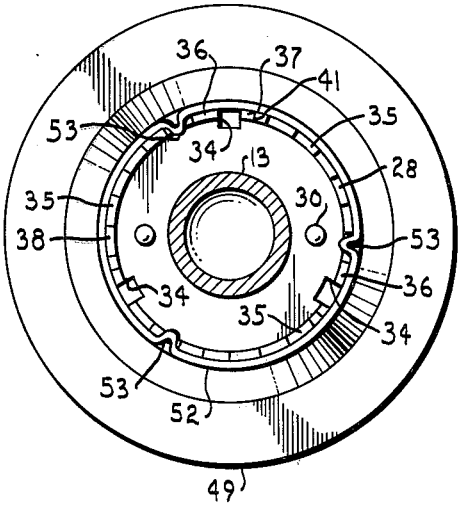
FIG. 6 is a plan view similar to FIG. 5 but showing the bosses engaged in an adjusted position against selected shoulder joints.
Figure 7:
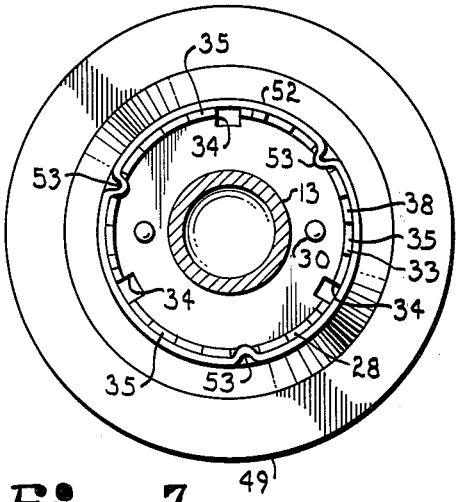
FIG. 7 is a plan view similar to FIG. 6 but showing the bosses engaged in a further adjusted position.

The term "rotatively engageable boss and shoulder joint" as used herein is intended to mean a joint whereby two members can be selectively engaged in an interlocking relationship by partial rotation of one of the members for abutment of at least one boss thereon with a corresponding shoulder on the other member, whereby axial movement of the rotated member from the joint is prevented until downwardly directed pressure is relieved.

Unless otherwise indicated, the terms "inner," "outer," "inwardly," "outwardly," "rearwardly" and "forwardly" as used herein are with reference to the general direction in which the nozzle of the sprinkler is pointed, e.g., the nozzle is pointed outwardly and liquid is jetted forwardly therefrom.

As shown in the drawings, the sprinkler head comprises a body 1 having a nozzle 2, a yoke frame 3 and a threaded connector 4 thereon. The yoke frame comprises two arms 5 and 6 which extend away from the nozzle longitudinally with respect to the discharge axis A—A thereof, and the arms merge at junction 7 in front of the nozzle. Located between nozzle 2 and junction 7 is a thermally responsive element 8, in this example, of the frangible pellet type. The outer tip 9 of the element rests in a socket in the inner end of a set screw 10. The set screw 10 extends downwardly through the junction 7 and a circular deflector plate 17 is mounted to the lower end thereof. The inner end of the element 8 is a cap 11 and a polymeric or soft metal disk 12 is placed between the cap and the nozzle 2 to provide a seal against leakage of a fire extinguishing fluid, such as water, that is supplied through connector 4 from a pipe 13 connected to a fluid supply. The pressure applied to the disk 12 by means of the cap 11 is regulated by turning the set screw 10.

Should a fire occur within the enclosed space wherein the sprinkler is located, the heat from the fire will melt the frangible pellet of the thermally responsive element 8 so that holding pressure on the disk 12 and cap 11 will be released, allowing water to be discharged from the nozzle 2. Following thermal activation, the element 8 is knocked aside by the water so that a substantially solid stream thereof can be directed onto the upper surface of the deflector plate 17, thereby atomizing the water stream and producing a desired pattern of droplet distribution by the sprinkler.

The ceiling tile 62 must never extend below the sprinkler body 1, FIG. 1 because the crucial spray pattern would then be disturbed. Improper ceiling construction and weakening of the tile due to age or water damage may cause the ceiling tile to sag downwardly and seriously interfere with the proper operation of the sprinklers. To prevent rearward retraction of the sprinkler body through the ceiling opening 61 and to act as a decorative escutcheon, flanges described below may be employed.

FIGS. 1–8 represent an adjustable sprinkler having a semi-recessed flange generally represented at 49. The flange 49 comprises a flat annular ring 50 located forwardly of the nozzle 2 and rearwardly of the deflector plate 17, and a truncated conical section 51 which converges rearwardly of the ring 50 and merges with a cylindrical wall ring mount 52 having bosses 53 thereon at the inner end and which project radially inward.

The flange 49 mounts onto a bracket 28 secured to the sprinkler body 1 (FIG. 1). The bracket 28 is comprised of a circular, flat plate 29 and an outer, integral ring 33. The bracket is secured to the sprinkler body 1 by rivets 30 (FIG. 5) extending through the plate 29 and engaging in the yoke frame 3. The bracket plate 29 further includes an inside circular opening 31 to accommodate the passage therethrough of the connector 4.

The bracket ring 33 has three equi-distantly circumferentially spaced vertical transfer channels 34 therein which are open at opposite ends thereof. The ring 33 is of an outside diameter to telescopically accommodate the inside diameter of the flange ring mount 52, except for the bosses 53 which must project into the channels 34 for relief during the flange passage. Thus, the flange 49 can be slipped axially inwardly or upwardly for passage of the ring mount 52 over the ring 33 upon alignment of the bosses 53 with the channels 34. Since the channels 34 are open at opposite ends thereof, they extend through the bracket plate 29, as is best shown in FIG. 5.

The bracket ring 33, in this example, further includes three upwardly and diagonally directed series of saw-tooth-like shoulders, generally represented by the reference numeral 35, although a lesser or greater number may be used if desired. The circumference of the bracket ring 33 is equally divided into the three saw-toothed series 35, each starting with a lowest shoulder 36 adjacent each channel 34 and serially progressing upwardly to a highest shoulder 37 adjacent the next channel 34. The illustrated embodiment has a highest shoulder 37 and seven shoulders 38, which includes the shoulder 36, in each of the series 35 thereof, permitting eight axial relative positions with respect to the flange 49. Each shoulder 38 includes a generally horizontal but downwardly or outwardly sloping portion 39 directed toward a generally vertically directed portion 40 which provides a step to the next shoulder 38 in the series 35. The highest shoulder 37, which adjoins a channel 34, merely includes an indented portion 41, FIG. 1.

When mounting the flange 49 to the bracket 28, the bosses 53 are aligned with the respective channels 34 and the flange is telescoped or slipped over the bracket to a point where the bosses 53 are above the lowermost shoulders 36 and the ring 50 engages with the ceiling tile 62. The flange 49 is then rotated for less than a one-third turn to bring the hosses 53 into abutment with an apropriately positioned shoulder 38 located on the bracket ring 33. Once so installed, the flange is retained in position by the boss and shoulder joints in combination with the downwardly directed force from the weight or resiliency of the ceiling tile pressing upon the flange flat ring 50.

To dismount the flange 49 from the bracket 28, the flange 49 is partially rotated in the opposite direction for realignment of the bosses 53 with the channels 34. The slight downwardly sloping portion 39 of each shoulder 38 necessitates a slight upward movement of the flange 49 as it is turned.

Figure 8:
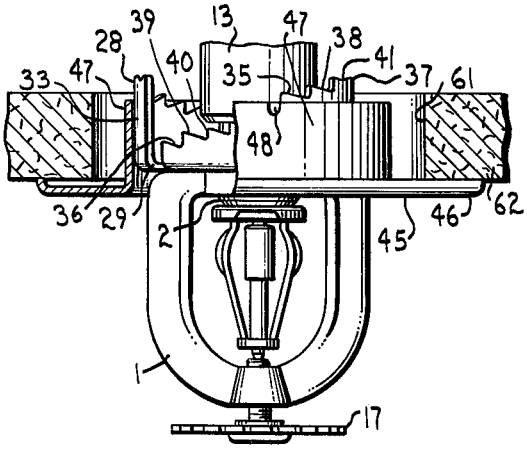
FIG. 8 is a partially sectional view in side elevation of a sprinkler head assembly having an alternative flange form which maintains the head in a less deeply recessed position.

FIG. 8 illustrates an alternative form of the invention adapted for use with a non-recessed sprinkler head. A flange 45, in this example, includes a flat annular ring 46 located at approximately the same elevation as the sprinkler head nozzle 2, FIG. 8. A ring mount 47, corresponding to the ring mount 52 described above, has bosses 48 thereon at the inner or upper end and which project radially inwardly for the same purpose. Likewise, the flange 45 is mounted to the sprinkler head body 1, FIG. 8, in the same manner as the flange 49, FIGS. 1–7, the essential difference of this embodiment over that of FIGS. 1–7 being the absence of the conical section 51 (FIG. 1) or its equivalent.

FIGS. 9–11 illustrate an embodiment wherein the flange is not adjustable on the sprinkler head. The flanges for either the fully projecting (FIG. 8) or the semi-recessed (FIGS. 1–7) heads may be employed in a similar manner for mounting onto a bracket 43 on the sprinkler head body 1, FIG. 9. The bracket 43 comprises a plate 56 and an integral peripheral bracket ring 55. Like the bracket 28, FIGS. 1–8, the bracket 43 is secured to the sprinkler head body 1 by suitable fasteners 54 extending thereinto. Utilizing the flange 49 described above (FIG. 1), in this embodiment the flange 49 (FIG. 9) is slipped over the bracket ring 55 upon alignment of the bosses 53 with channels 57 which extend through the bracket plate 56 and the bracket ring 55. After the flange has been slipped upwardly or inwardly past the bracket 43 to a point where the bosses 53 have left the channels 57, the flange is rotated for less than a ⅓ turn to bring the bosses 53 into abutment with shoulders 58 which are located on the bracket ring adjacent the channels. Once installed on the bracket, the flange 49 is retained in position by the boss and shoulder joints until it is rotated for realignment of the bosses 53 with the channels 57.

To prevent unintentional unlocking of the flange 49 from the bracket of the sprinkler, the inner end openings 59 of the channels 57 are located above said shoulders, and sloping transitions 60 are provided therebetween. Accordingly, as with the bracket 38, FIGS. 1–8, the bosses 53, FIGS. 9–11, on the emplaced flange 49 cannot be realigned with the channels 57 in the bracket 43 without movement of the flange 49 inwardly or upwardly as it is turned.

The flange and bracket arrangements disclosed herein are usable with either ceiling or sidewall mounted sprinklers, and either the flange 45 or the flange 49 decoratively covers an annular opening 61 in a ceiling or wall structure 62 while also serving as a brace to prevent retraction of the sprinkler head through the opening therein. It will also be understood that the present invention can be used with non-automatic sprinkler heads, i.e., those not having a thermally responsive element.

An improved sprinkler head assembly which fulfills the previously stated objects has now been disclosed in detail, and although the invention has been described with reference to particular apparatus, combinations and arrangements of apparatus, conditions of use, and the like, it will nonetheless be understood that even other embodiments will become apparent which are within the spirit and scope of the invention defined in the following claims.

What is claimed and desired to secure by Letters Patent is:

1. A sprinkler head assembly for mounting with respect to a surface comprising:

(a) a sprinkler head body having a nozzle therein;

(b) a bracket attached to said body and having a plate extending radially outwardly therefrom and a ring extending normally of said plate at the periphery thereof, said ring having at least one upwardly directed channel dividing said ring and open at opposite ends thereof, one of said channel ends corresponding with a notch in said plate, means on said ring forming at least one engageable shoulder circumferentially offset from said channel;

(c) an annular flange receiving said body thereinto and surrounding said bracket, said flange being telescopically movable over said bracket and having at least one boss thereon projecting inwardly thereof a distance greater than the radial thickness of said ring and blocking said movement in absence of alignment with said channel, said flange being supported on said bracket by circumferential alignment with axial movement of said boss through and beyond said notch and channel and rotation of said boss relative to said bracket into engagement with said shoulder; and (d) a support member on said flange and adapted for engaging said surface.

2. A sprinkler head assembly as in claim 1 wherein said bracket shoulder is a slanted saw-toothed shape providing boss receiving rests at various elevations with respect to said surface.

3. A sprinkler head assembly as in claim 1 wherein said channel has an upper opening positioned above said shoulder.

4. A sprinkler head assembly as in claim 3 further comprising means forming sloping transitional sections located between said upper opening and said shoulder.

5. A sprinkler head assembly as in claim 1 wherein said flange comprises a ring mount having a plurality of said bosses thereon corresponding to an equal number of shoulders on said bracket.

6. A sprinkler head assembly as in claim 1 wherein said annular flange comprises a truncated conical section separating said flange support member from said boss.

7. A sprinkler head assembly as set forth in claim 1 wherein said flange support member is a flat annular ring and said body projects therethrough.

8. A sprinkler head assembly as set forth in claim 1 wherein said flange boss projects from a cylindrical wall.

* * * * *